US005078519A

United States Patent [19]

Takita et al.

[11] Patent Number: 5,078,519

[45] Date of Patent: Jan. 7, 1992

[54] PRINTER WITH TWO-STAGE SKEW ADJUSTMENT

[75] Inventors: Masaaki Takita, Ibaraki; Yoshikazu Tsuru, Hirakata; Toshiharu Kitagawa, Katano; Yoshikazu Nomura, Osaka, all of Japan

[73] Assignee: Matsushita Electric Industrial, Co., Ltd., Osaka, Japan

[21] Appl. No.: 408,361

[22] Filed: Sep. 18, 1989

Related U.S. Application Data

[62] Division of Ser. No. 155,098, Feb. 11, 1988, Pat. No. 4,881,831.

[30] Foreign Application Priority Data

Feb. 18, 1987 [JP] Japan ..... 62-35033
Feb. 18, 1987 [JP] Japan ..... 62-35036

[51] Int. Cl.[5] ..... B41J 3/02

[52] U.S. Cl. ..... 400/120; 400/240.3; 400/618

[58] Field of Search ..... 400/120, 240.3, 240.4, 400/608.3, 617, 618, 636, 619, 208, 211; 346/76 PH, 134, 146

[56] References Cited

U.S. PATENT DOCUMENTS

| | | | |
|---|---|---|---|
| 4,327,366 | 4/1982 | Schafter et al. | 400/120 |
| 4,552,470 | 11/1985 | Yana et al. | 400/618 |
| 4,562,443 | 12/1985 | Matsuno et al. | 400/240.3 |
| 4,577,199 | 3/1986 | Saiki et al. | 400/240.3 |
| 4,625,218 | 11/1986 | Watanabe | 400/240.3 |
| 4,668,961 | 5/1987 | Hiramatsu | 400/120 |
| 4,693,620 | 9/1987 | Harumatsu | 400/636 |
| 4,698,650 | 10/1987 | Watanabe et al. | 400/625 |
| 4,738,555 | 4/1988 | Nagashima | 400/120 |
| 4,750,006 | 6/1988 | Hashimoto | 346/134 |
| 4,769,103 | 9/1988 | Koiki et al. | 400/120 |

FOREIGN PATENT DOCUMENTS

| | | | |
|---|---|---|---|
| 0070586 | 4/1984 | Japan | 400/240.4 |
| 59-209169 | 11/1984 | Japan . | |
| 61-63463 | 4/1986 | Japan . | |
| 0290076 | 12/1986 | Japan | 400/240.3 |
| 0291158 | 12/1986 | Japan | 400/618 |
| 0229036 | 7/1987 | Japan | 400/618 |
| 0234966 | 10/1987 | Japan | 400/618 |
| 2141385 | 12/1984 | United Kingdom | 400/240.3 |

*Primary Examiner*—Eugene H. Eickholt
*Attorney, Agent, or Firm*—Stevens, Davis, Miller & Mosher

[57] ABSTRACT

Two-stage skew adjustment is achieved by first using only the drive force of the platen roller with the pinch roller and the capstan roller drive disrupted by a gap opening mechanism to effect a large skew adjustment. Then, the gap is closed and the platen roller, which has a Teflon-resin coating thereon and a larger diameter than the capstan roller or pinch roller, effects a small skew adjustment. Thereafter, printing is effected by feeding the paper in a reverse direction to register with an inked ribbon feed of a primary ribbon using the platen roller drive and the pinch roller drive with the skew cycle repeated for each ribbon color segment to achieve improved multicolor printing registration.

8 Claims, 6 Drawing Sheets

PRINTER WITH TWO-STAGE SKEW ADJUSTMENT

This is a division of application Ser. No. 155,098, filed Feb. 11, 1988, now U.S. Pat. No. 4,881,831.

BACKGROUND OF THE INVENTION

1. Field of the Invention

The present invention relates to a printer, and more particularly, to a heat transfer printer.

2. Description of Prior Art

FIG. 1 is an exploded perspective view of a conventional heat transfer color printer. As shown in the drawing, the conventional heat transfer color printer comprises the following components or portions: a lower cabinet 1; a circuit portion 2; a power supply panel 3; a pinch roller 4; a capstan roller 5, against which the pinch roller 4 is adapted to abut to impart a driving force to the same; a platen roller 6, which, together with the pinch roller 4 and the capstan roller 5, constitutes a paper feeding mechanism; a main motor 7 for driving the capstan roller 5 and the platen roller 6; a pinch lever 8 adapted to be interlinked with the movement of a cam to cause the pinch roller 4 to be brought into contact with the capstan roller 5 or to cancel the contact thereof; a release roller 9 for releasing an ink film from paper; a paper feed roller 10 for bringing the paper into contact with the platen roller 6; a paper guide 11 for guiding the paper; and a paper support 12 for supporting the paper wound in the form of a roll. The printer further comprises a cover frame 13; a lock lever 14; a lock lever shaft 15, which engages or disengages with and from the lock lever 14 to open or close the cover frame 13; a ribbon feed gear 16 disposed on the cover frame 13 and adapted to effect positioning of one end of a ribbon feed; a ribbon holder 17 similarly disposed on the cover frame 13 and adapted to impart a pressing force against the other end of the ribbon feed; a printing head holder 18: a printing head 19 sec red to the head holder 18; a head arm 20 which is operatively associated with the operation of a cam and to which the head 19 is secured; a cooling fan 21 for radiating heat from the main motor 7, the circuit portion 2 and the like; an operation panel 22; a top cover 23; and an upper cabinet 24.

In the conventional heat transfer color printer, the paper feeding and printing are carried out in the manner illustrated in FIGS. 2*a* and 2*b*.

At the time of printing, as shown in FIG. 2*b*, paper 25 is gripped by the capstan roller 5 and the pinch roller 4 and is fed in the direction of the arrow B. At this time, the printing head 19 is pressed by the platen roller 6, which races clockwise by means of a one-way clutch (not shown in FIG. 2*b*) and is rotated by the paper 25 only by an amount of feeding by the capstan roller 5.

Meanwhile, at the time of paper feeding, as shown in FIG. 2*a*, the capstan roller 5 and the pinch roller 4, while gripping the paper, rotate in the direction of the arrows a, b. At this time, the head 19 is located at a position spaced apart from the platen roller 6, and the paper 25 is gripped by the platen roller 6 and the paper feed roller 10 and is driven counterclockwise by means of the platen roller 6 which is engaged with the capstan roller 5 by the one-way clutch via gears.

Incidentally, yellow, magenta, and cyan are arranged on an ink film 27 sequentially for each image plane, and the above-described operation is repeated three times to effect color printing.

However, with the arrangement shown in FIGS. 2*a* and 2*b*, at the time when the paper 25 is set between the platen roller 6 and the pinch roller 4, if the paper 25 is set obliquely with respect to the direction A or B, or if it is set with the paper 25 slackened between the pinch and capstan rollers 4, 5 on the one hand, and the platen roller 6 on the other, the state of the oblique setting and slackening of the paper 25 remain as they are since both the platen roller 6 and the platen roller 5 are rotatively driven at the time of paper feeding and printing. For this reason, when printing is effected, there has been a drawback in that oblique printing and misalignment of printing can occur.

SUMMARY OF THE INVENTION

Accordingly, the object of the present invention is to provide a heat transfer color printer having a paper advancing mechanism which is capable of positively eliminating paper slackness between a capstan roller and a platen roller at the time of paper feeding and substantially eliminates misalignment of printing.

To this end, in accordance with the present invention, there is provided a printer comprising: a capstan roller, a pinch roller provided in correspondence with the capstan roller; a printing head for applying heat to an ink film; a platen roller having sliding friction; and a paper feed roller disposed in correspondence with the platen roller, wherein, during printing, the paper is fed by the capstan roller, and, during paper feeding, the paper is fed by the capstan roller and the platen roller and is caused to slide relatively over the platen roller.

DESCRIPTION OF THE PREFERRED EMBODIMENTS

The present invention is arranged such that, during printing, paper is fed by a capstan roller, and during paper feeding, paper is fed at least by a platen roller, and the paper is caused to slide relatively over the platen roller. Therefore, when an uneven slack has occurred between the right- and left-hand sides of the paper between a capstan roller and the platen roller, such slack of the paper is eliminated by causing the paper to slide over the platen roller during paper feeding.

Referring now to the accompanying drawings, description will be given of the preferred embodiments of the present invention.

Embodiment 1

Figure 1:
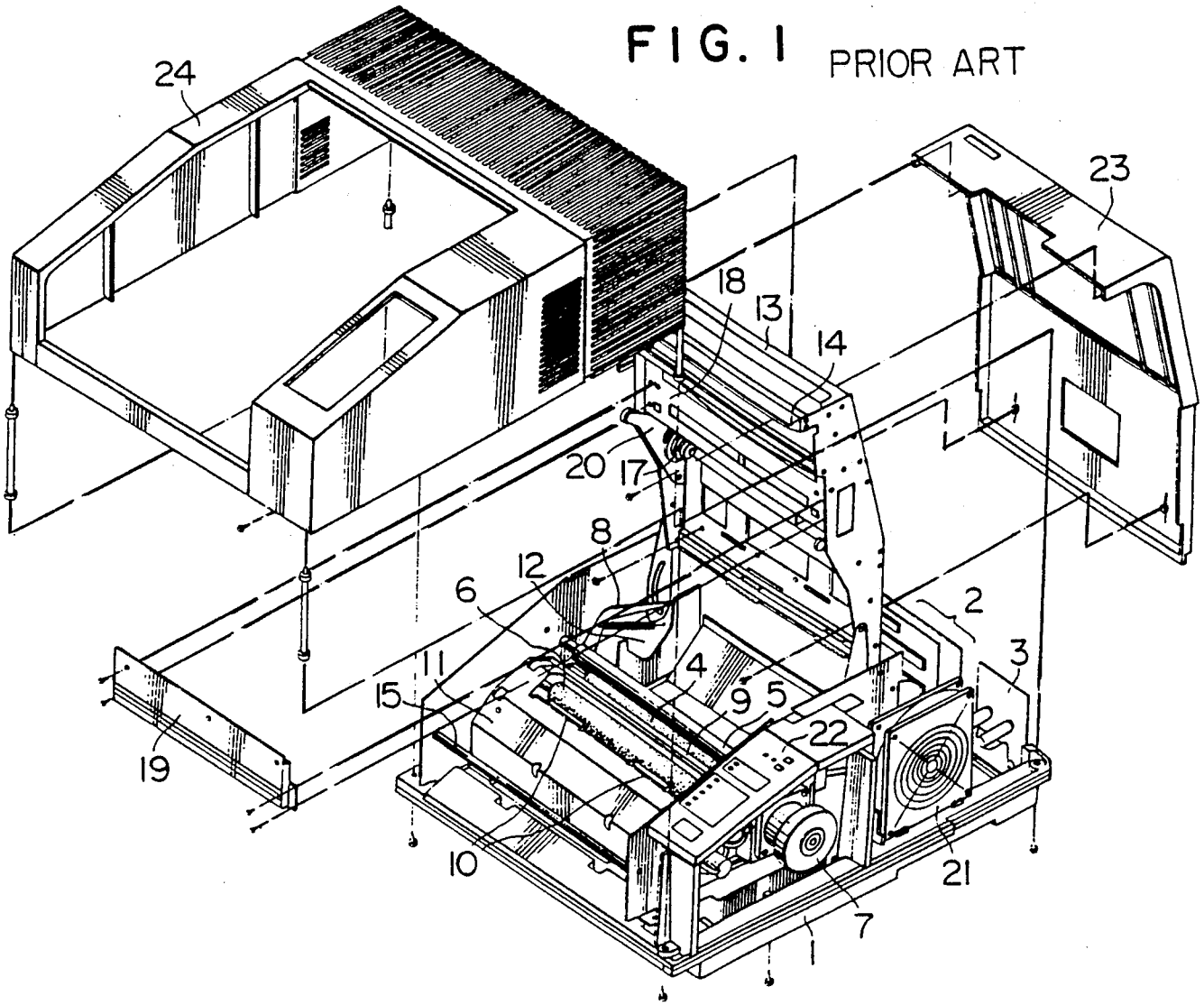
FIG. 1 PRIOR ART
FIG. 1 is an exploded perspective view of a conventional heat transfer color printer.
Figure 2A:
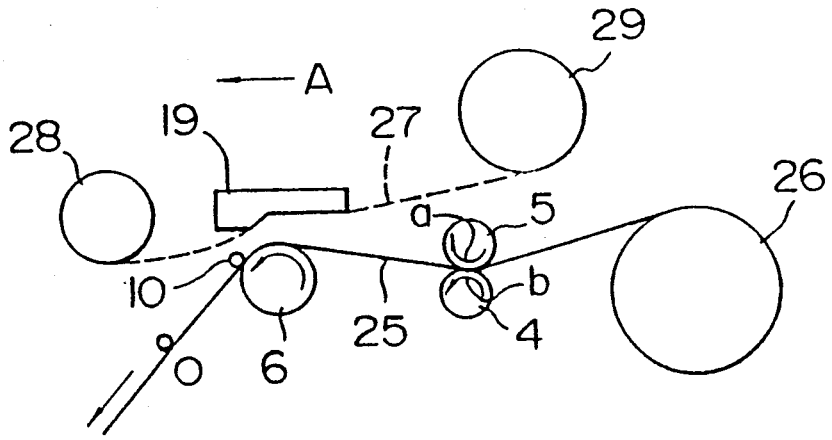
FIG. 2a PRIOR ART
FIGS. 2*a*, 2*b*, 3*a* and 3*b* are diagrams schematically illustrating paper feeding and printing mechanisms.
Figure 2B:
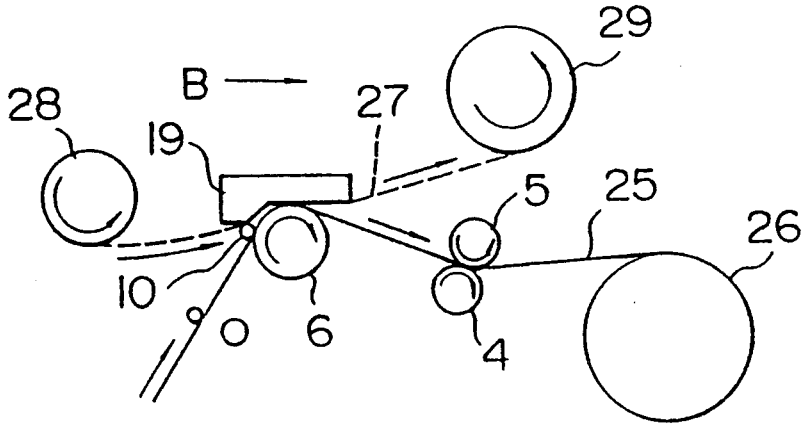
FIG. 2b PRIOR ART
Figure 3A:
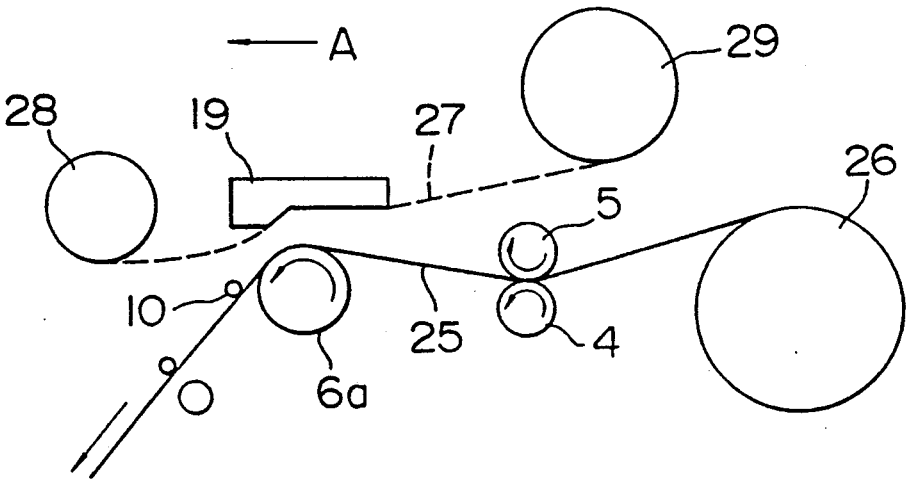
Figure 3B:
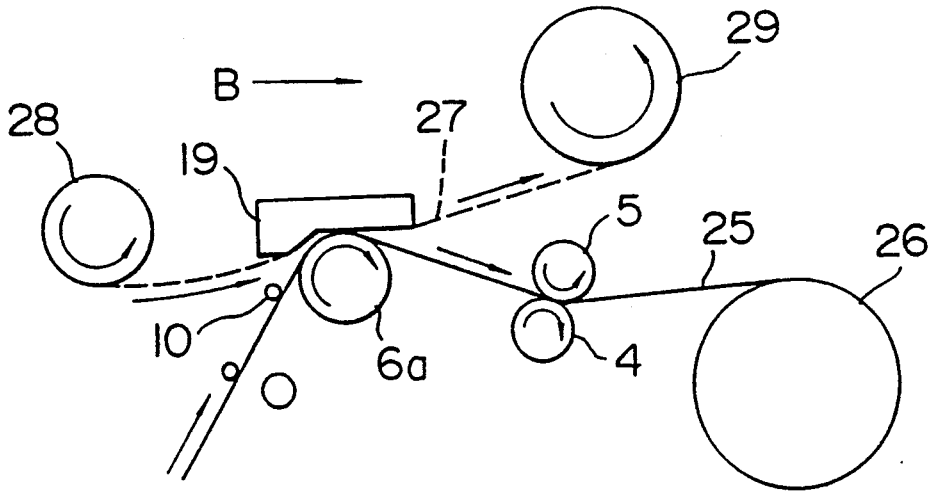

FIGS. 3*a* and 3*b* are diagrams schematically illustrating paper feeding and printing sections of a printer in accordance with a first embodiment of the present invention.

First, at the time of paper feeding, as shown in FIG. 3*a*, paper 25 is fed by an amount corresponding to one image plane from a paper holder 26 in the direction of the arrow A by the counterclockwise rotational driving forces of a pinch roller 4 and a platen roller 6*a*. At this time, a printing head 19 is located at a position spaced apart a relatively large distance from the platen roller 6*a*, an ink film 27 remains stopped, and printing is not effected. In order to prevent paper slackness between the capstan roller 5 and the platen roller 6*a*, the outside diameter of the platen roller 6*a* is made greater than a theoretical value by a very small amount, and the platen roller 6*a* is thereby adapted to feed the paper by an amount several millimeters greater than an amount of feeding by the capstan roller 5.

In addition, in this embodiment, the platen roller 6*a* is so arranged that its surface has a lower coefficient of sliding friction than that of the conventional platen roller 6, and there is provided a paper feed roller for bringing the paper into contact with the platen roller 6*a* at a fixed winding angle. For this reason, the surface of the platen roller 6*a* is coated with a Teflon-based resin material.

Incidentally, in FIG. 3*a*, reference numeral 28 denotes an ink film holder, while numeral 29 denotes an ink film takeup holder.

At the time of printing, as shown in FIG. 3*b*, the platen roller 6*a* and the pinch roller 4 rotate clockwise, and the paper 25 is unwound by the amount of one image plane in the direction of the arrow B. At this time, the head 19 is in contact with the platen roller 6*a* , the ink film holder 28 and the ink film takeup holder 29 rotate counterclockwise, and the ink film 27 is unwound in the direction of the arrow B. Subsequently, heat is applied from the head 19 to the ink film 27, and predetermined printing is effected on the paper 25.

Yellow, magenta, and cyan are arranged sequentially within each image plane, and color printing is carried out by repeating the above-described operation three times.

Figure 4A:
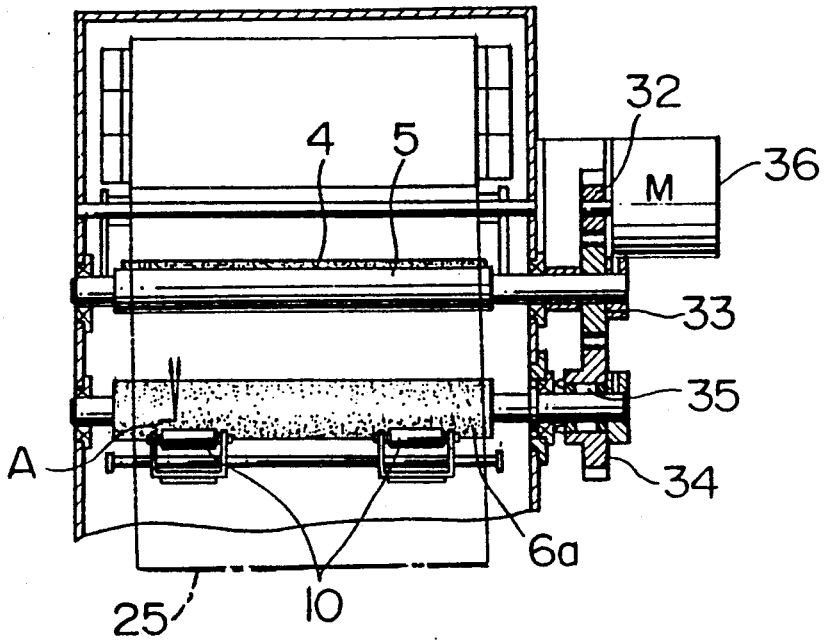
FIGS. 4*a* and 4*b* are top plan views illustrating a paper slack correcting mechanism.
Figure 4B:
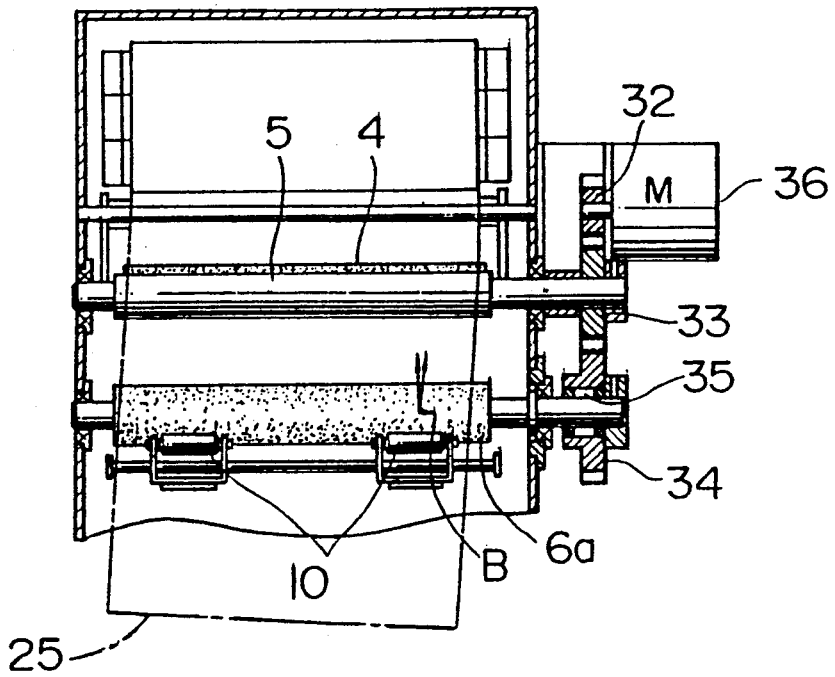

FIGS. 4*a* and 4*b* are top plan views schematically illustrating a heat transfer color printer in accordance with an embodiment of the present invention.

First, the paper 25 is fed forward while being clamped by the pinch roller 4 and the capstan roller 5. At this time, the platen roller 6*a* is rotated by a one-way clutch 35 in synchronization with the capstan roller 5 via gears 32, 33 and 34, and the amount of the paper 25 fed by the platen roller 6*a* is greater than that fed by the pinch roller 4 and the capstan roller 5 to the extent that the diameter of the platen roller 6*a* is made greater. A pressing force of the paper feed roller 10 acting on the paper 25 helps to feed the paper 25 further by applying tension thereon. The slack of the paper 25 due to slippage of the paper 25 over the platen roller 6*a* is thereby eliminated. Subsequently, the head 19 is brought into contact with the platen roller 6*a*, and as the motor 36 is rotated reversely, the paper 25 is fed backward while being pinched between the capstan roller 5 and the pinch roller 4, and printing is then carried out.

In this embodiment, by virtue of the above-described arrangement, as shown in FIG. 4*a*, if a greater amount of slack has occurred on the right-hand side, as viewed in the drawing, between the capstan roller 5 and the platen roller 6*a*, the tension on the left-hand side becomes greater than that on the right-hand side. Accordingly, a component force A is generated in the direction of the left-hand side by the tension acting on the left-hand side of the paper 25, and the paper 25 is thereby pulled leftwardly until the slack of the paper 25 is eliminated. In addition, if a greater amount of slack has occurred on the left-hand side, as shown in FIG. 4*b*, the paper 25 is pulled rightward by a component force B until the slack is eliminated, and its slack is thus corrected. Hence, the correction of the feed path of the paper 25 is effected by allowing the paper 25 to be slid on the platen roller 6*a*.

As has been described above, in accordance with this embodiment, since it is possible to correct the slack of the paper resulting from a degree of non-parallelism of the paper between the rollers, printing is always effected in a favorable state, so that it is possible to provide a high-quality printer.

Embodiment 2

In the case of the above-described embodiment 1, it is impossible to correct a large degree skew (meandering) which occurs when the paper 25 is mounted. Therefore, in this embodiment, an arrangement is provided to allow a large degree skew to be corrected first and a small degree skew to be corrected afterwards.

Figure 5A:
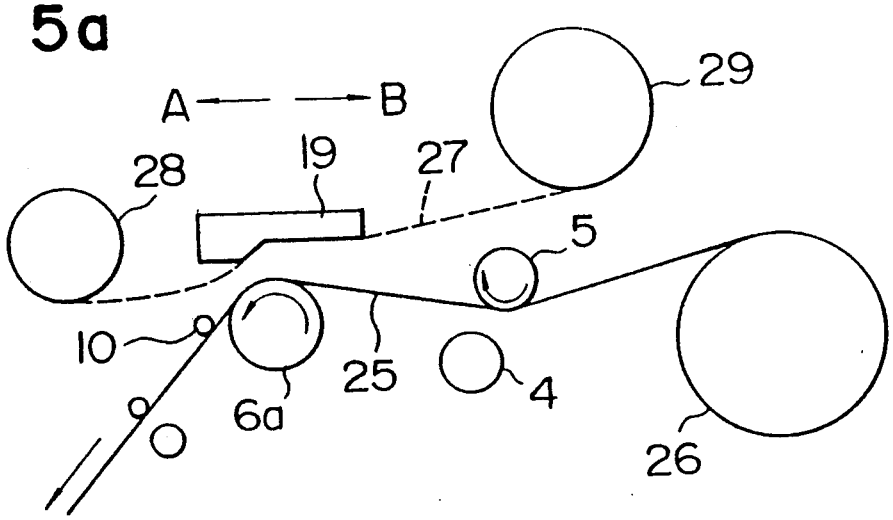
FIGS. 5*a*, 5*b* and 5*c* are diagrams schematically illustrating the operation of paper-feeding and printing mechanisms of the heat transfer color printer.
Figure 5B:
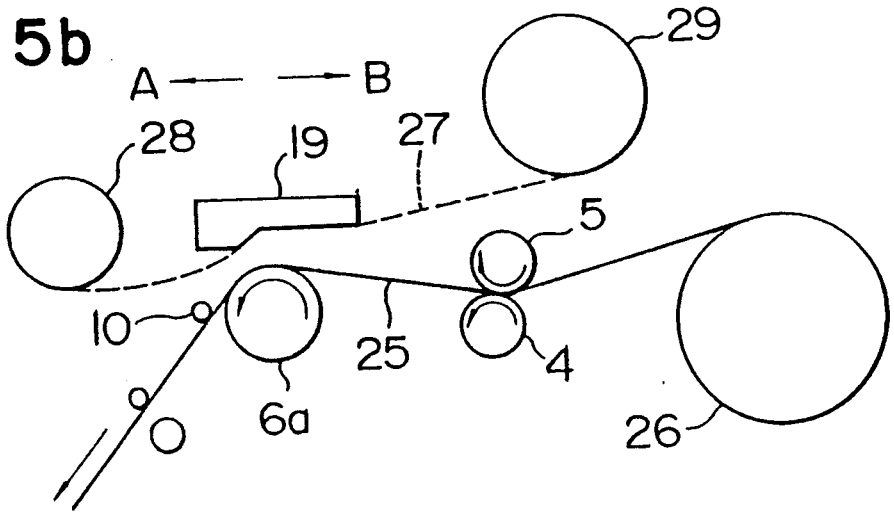
Figure 5C:
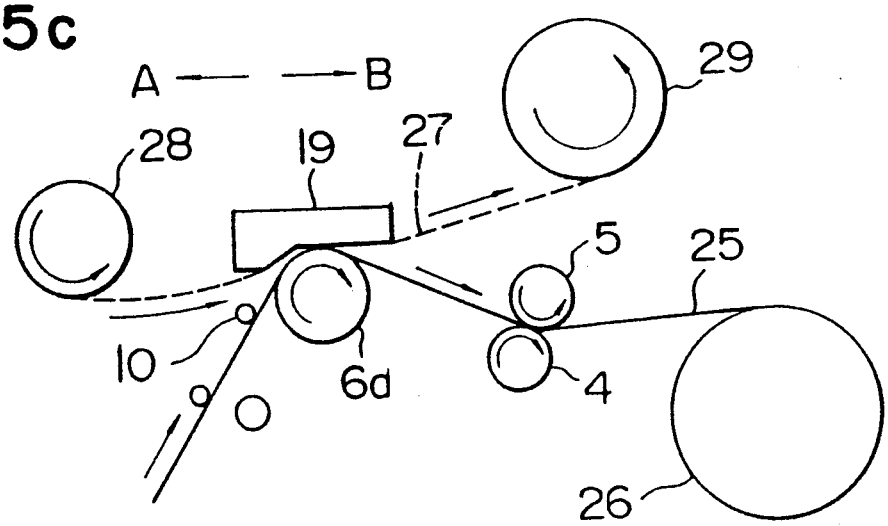

FIGS. 5*a*, 5*b* and 5*c* are diagrams schematically illustrating the operation of paper feeding and printing sections of the heat transfer color printer in accordance with this embodiment.

First, at the time of the primary paper feeding for correcting a large degree skew, as shown in FIG. 5*a*, the pinch roller 4 is located spaced apart a relatively large distance from the capstan roller 5, and no driving force is imparted to the paper 25 by the capstan roller 5. Consequently, the paper 25 is fed about by an amount corresponding to one fourth of the image plane in the direction of the arrow A by the counterclockwise rotation of the platen roller 6*a* alone. If the paper 25 slants toward, for instance, the right-hand side with respect to the direction of the arrow A, the tension between the platen roller 6 and the paper holder 26 in the direction of the arrow B is greater on the left-hand side with respect to the direction of the arrow A than on the right-hand side. Accordingly, as the platen roller 6*a* rotates, the paper 25 slidingly moves toward the left-hand side from the right-hand side with respect to the direction of the arrow A in the axial direction of the platen roller 6*a*. The correction of the feed path of the paper 25 is thus carried out. In addition, even if the paper 25 is set in a slack condition, it is possible to eliminate the slack on the above-described principle.

During the secondary paper feeding for correcting a small degree skew, as shown in FIG. 5B, the pinch roller 4 moves to a position at which it is brought into contact with the capstan roller 5, and the paper 25 is fed about by three fourths of the image plane in the direction of the arrow A, and the feeding operation of the paper 25 is thereby completed. At this time, the correction described in Embodiment 1 is carried out.

During printing, in the same way as the conventional example, the paper 25 and the ink film 27 are unwound by one image plane in the direction of the arrow B, and printing on one image plane is effected in the meantime (see FIG. 5C).

Yellow, magenta, and cyan are arranged on the ink film 27 sequentially on each image plane, and color printing is effected by repeating the above-described operation three times. Accordingly, since, upon starting of each paper feeding, the operation shown in FIG. 5A is carried out, the feed path of the paper 25 is corrected on each such occasion. Therefore, printing is always effected in a favorable condition. In particular, since the slack of the paper 25 is caused by the nonuniformity of the diameter of the capstan roller 5, nonuniform pressing, uneven urging forces of springs disposed at opposite ends of the paper holder 26, shrinkage of the paper, or the like, the fact that the paper feed path is corrected on the occasion of each printing bears great significance meaning.

Figure 6A:
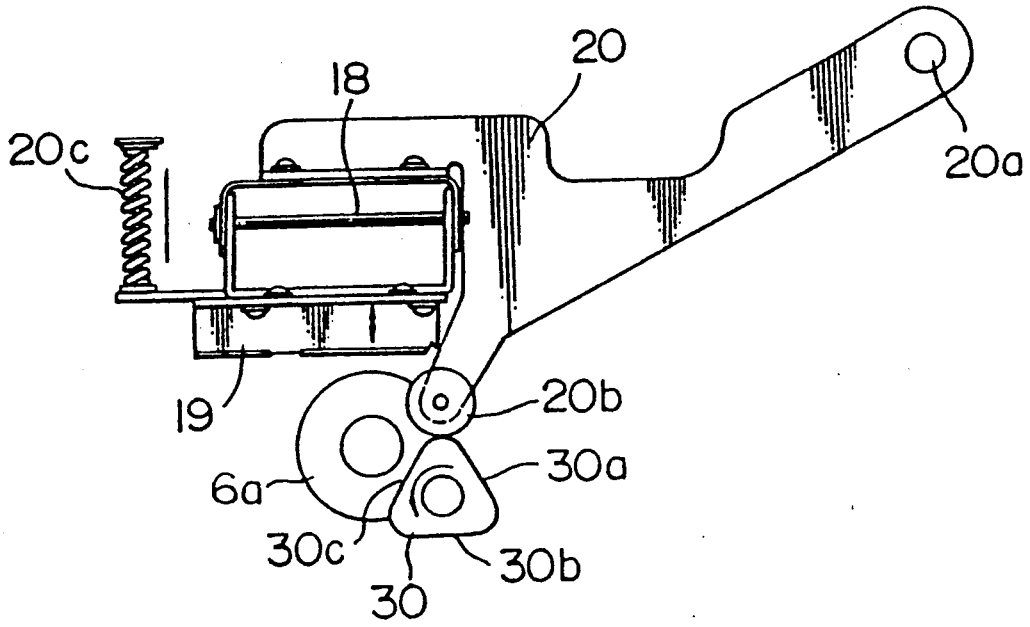
FIGS. 6*a* and 6*b* are diagrams schematically illustrating a head updown mechanism for realizing the operation shown in FIGS. 5*a*, 5*b* and 5*c* and a pinch roller opening and closing mechanism.
Figure 6B:
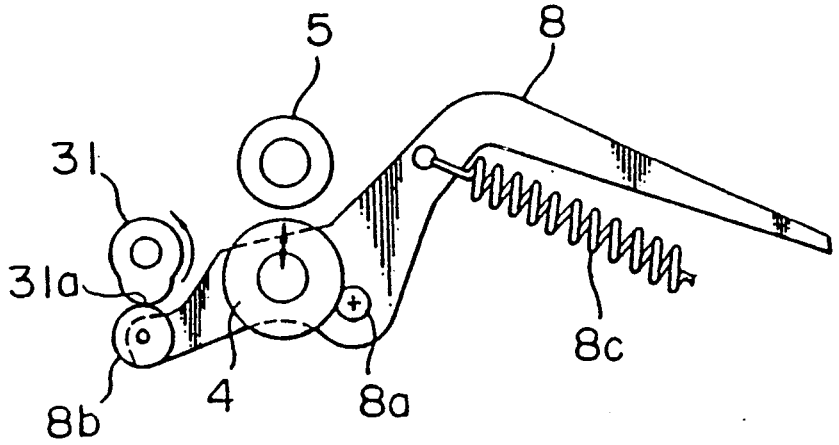

Referring now to FIGS. 6*a* and 6*b*, description will now be made of the operation of the lever and the cam which control the operation of the pinch roller 4 and the head 19.

FIG. 6*a* is a diagram schematically illustrating a printing head up-down mechanism.

As is apparent from the drawing, by virtue of the counterclockwise rotation of a cam 30 and the action of a head holding spring 20*c*, the head arm 20 which traces the cam 30 by means of a roller 20*b* moves vertically about a fulcrum 20*a* as its rotational center, so as to move the head 19 vertically. Namely, the head 19 is brought into contact with the platen roller 6 when the roller 20*b* traces each point 30*a*, 30*b* and 30*c* of the cam 30 the point 30*a* corresponding to yellow printing, the point 30*b* to magenta printing, and the point 30*c* to cyan printing, respectively.

FIG. 6*b* is a diagram schematically illustrating a pinch roller opening and closing mechanism. As is apparent from the drawing, by virtue of the counterclockwise rotation of a cam 31 and the action of a spring 8*c*, the pinch lever 8 which traces the cam 31 by means of a roller 8*b* moves vertically about a fulcrum 8*a* as its rotational center, and the gap between the pinch roller 4 and the capstan roller 5 is thereby opened and closed. Namely, the gap between the pinch roller 4 and the capstan roller 5 is opened at a point 31*a*, but is closed at the other points.

The cams 30 and 31 are adapted to rotate concentrically, and operations shown in FIGS. 6*a* and 6*b* are effected simultaneously in conjunction with the rotation of the cams 30, 31, and the operations described with reference to FIGS. 5*a*, 5*b* and 5*c* are performed.

Although, in the above-described embodiment, the operation is effected by means of a cam mechanism, it goes without saying that it is possible to realize the operations shown in FIGS. 5*a* to 5*c* even if, for instance, a solenoid or the like is used.

As has been described above, in accordance with the present invention, since the correction of the feed path of the paper can be performed in advance of printing, printing is always carried out in a favorable condition, so that it is possible to provide a high-quality heat transfer printer.

What is claimed is:

1. A printer comprising:

a capstan roller;

a pinch roller cooperating with said capstan roller to clamp paper therebetween, one of said capstan roller and said pinch roller being movable toward and away from the other such that a gap can be opened and closed therebetween;

a paper feed means positioned upstream of said capstan roller and said pinch roller, for feeding the paper while applying a back tension to the paper;

an ink film feed means for feeding an ink film;

a platen roller positioned downstream of said capstan roller and said pinch roller;

a printing head for abutting against said platen roller with the paper and said ink film being held therebetween, for applying heat to said ink film so as to effect printing on the paper;

a paper feed roller opposed to said platen roller with the paper being held therebetween;

a paper drive means for moving the paper through a feed path between said capstan roller and said pinch roller, and said platen roller and said paper feed roller; and an opening and closing means for opening and closing said gap between said capstan roller and said pinch roller; wherein said opening and closing means, upon initiation of a paper feed operation, opens said gap between said capstan roller and said pinch roller so as to enable the paper to be fed downstream by a drive force applied by said platen roller which clamps the paper between itself and said paper feed roller; and opening and closing means thereafter closes said gap between said platen roller and said pinch roller during the paper feed operation so as to feed the paper downstream while it is clamped between said capstan roller and said pinch roller and between said platen roller and said paper feed roller in a condition in which the paper is allowed to slip on said platen roller; and during a printing operation, said opening and closing means closes said gap between said pinch roller and said capstan roller to enable the paper to be fed upstream, in synchronized relationship with a feed operation by said ink film feed means, by said capstan roller and said pinch roller while printing is effected by said printing head.

2. A printer as set forth in claim 1, wherein during said paper feed operation, when said opening and closing means closes said gap between the capstan roller and the pinch roller so as to enable downstream feeding of the paper while it is clamped between said capstan roller and said pinch roller and between said platen roller and said paper feed roller, an amount of feeding of the paper by said platen roller is greater than an amount of feeding of the paper by said capstan roller.

3. A printer as set forth in claim 1, wherein said platen roller has an outer surface which includes a Teflon-resin coating.

4. A printer as set forth in claim 1, wherein said opening and closing means comprises a cam.

5. A printer for use with an ink film driven by a feed means, a printer comprising:

a capstan roller;

a pinch roller cooperating with said capstan roller to clamp paper therebetween, one of said capstan roller and said pinch roller being movable toward and away from the other such that a gap can be opened and closed therebetween;

a paper feed means positioned upstream of said capstan roller and said pinch roller, for feeding the paper while applying a back tension to the paper;

a platen roller positioned downstream of said capstan roller and said pinch roller;

a printing head for abutting against said platen roller with the paper and the ink film being held therebetween, for applying heat to the ink film so as to effect printing on the paper;

a paper feed roller opposed to said platen roller with the paper being held therebetween;

a paper drive means for moving the paper through a feed path between said capstan roller and said pinch roller, and said platen roller and said paper feed roller; and an opening and closing means for opening and closing said gap between said capstan roller and said pinch roller; wherein said opening and closing means, upon initiation of a paper feed operation, opens said gap between said capstan roller and said pinch roller so as to enable the paper to be fed downstream by a drive force applied by said platen roller which clamps the paper between itself and said paper feed roller; said opening and closing means thereafter closes said gap between said platen roller and said pinch roller during the paper feed operation so as to feed the paper downstream while it is clamped between said capstan roller and said pinch roller and between said platen roller and said paper feed roller in a condition in which the paper is allowed to slip on said platen roller; and during a printing operation, said opening and closing means closes said gap between said pinch roller and said capstan roller to enable the paper to be fed upstream by said capstan roller and said pinch roller while printing is effected by said printing head.

6. A printer as set forth in claim 5, wherein during said paper feed operation, when said opening and closing means closes said gap between the capstan roller and the pinch roller so as to enable downstream feeding of the paper while it is clamped between said capstan roller and said pinch roller and between said platen roller and said paper feed roller, an amount of feeding of the paper by said platen roller is greater than an amount of feeding of the paper by said capstan roller.

7. A printer as set forth in claim 5, wherein said platen roller has an outer surface which includes a Teflon-resin coating.

8. A printer as set forth in claim 5, wherein said opening and closing means comprises a cam.

* * * * *